US005820728A

United States Patent [19]

Stevens et al.

[11] Patent Number: 5,820,728

[45] Date of Patent: Oct. 13, 1998

[54] TAPE DISPENSER

[75] Inventors: Christopher John Stevens, Berkshire; Robert White, Oxford, both of Great Britain

[73] Assignee: The Gillette Company, Boston, Mass.

[21] Appl. No.: 849,156

[22] PCT Filed: Nov. 8, 1995

[86] PCT No.: PCT/US95/14539

§ 371 Date: Jul. 8, 1997

§ 102(e) Date: Jul. 8, 1997

[87] PCT Pub. No.: WO96/15060

PCT Pub. Date: May 23, 1996

[30] Foreign Application Priority Data

Nov. 14, 1994 [GB] United Kingdom ..... 9422900

[51] Int. Cl.[6] ..... B32B 31/00

[52] U.S. Cl. ..... 156/577; 156/579; 242/364.1

[58] Field of Search ..... 156/527, 540, 156/577, 579; 242/364.1

[56] References Cited

U.S. PATENT DOCUMENTS

| | | | |
|---|---|---|---|
| 4,274,906 | 6/1981 | Clar | 156/540 |
| 4,671,687 | 6/1987 | Tamai | 400/695 |
| 4,853,074 | 8/1989 | Manusch et al. | 156/577 |
| 4,997,512 | 3/1991 | Manusch | 156/577 X |
| 5,281,298 | 1/1994 | Poisson et al. | 156/577 X |
| 5,430,904 | 7/1995 | Ono et al. | 156/577 X |
| 5,490,898 | 2/1996 | Koyama | 156/579 X |
| 5,556,469 | 9/1996 | Koyama et al. | 156/579 X |
| 5,714,035 | 2/1998 | Stevens | 156/577 |

FOREIGN PATENT DOCUMENTS 656308 6/1995 European Pat. Off. .

*Primary Examiner*—Mark A. Osele

*Attorney, Agent, or Firm*—Chester Cekala; David A. Howley; Ladas & Parry

[57] ABSTRACT

A tape dispenser for applying a strip of a coating composition to a substrate, including a holder containing a supply spool of tape consisting of a carrier ribbon coated on one side with the composition, and a take-up spool for used tape consisting of carrier ribbon from which the composition has been removed. The tape is guided to pass between the supply and take-up spools around an edge of an application tip element used to press the ribbon against the substrate to transfer the composition onto the substrate. The application tip element is coupled to the holder for movement about a predetermined axis substantially aligned with the direction in which the element is pressed against the substrate in use of the dispenser. Frictional forces exerted on the application tip element during movement of the element across the substrate surface cause the element to move about the axis to maintain the edge substantially perpendicular to the direction of the movement of the element across the surface.

10 Claims, 5 Drawing Sheets

TAPE DISPENSER

This invention is concerned with tape dispensers for applying a coating composition as a strip or band to a substrate. For example, there are known so-called correction tape dispensers in which supply and take-up spools for a plastics carrier ribbon onto one side of which a correction composition is initially coated are housed in a holder which is held in the hand during use. In passing from the supply spool to the take-up spool the carrier ribbon passes around an edge defined by an application element and by means of which the ribbon is pressed against the surface of a sheet of paper in order to transfer the coating composition onto the paper such as to facilitate the correction of a mistake made during writing. The edge of the applicator element defines a sharp bend in the ribbon path to assist the release of the coating composition from the ribbon. As the edge is moved across the paper, fresh coated ribbon is drawn from the supply spool while the take-up spool is driven to wind up the ribbon which the edge has passed over and hence from which the coating composition has been removed. Thus, a straight continuous strip of coating composition is laid down on the paper surface until the forward movement of the application element is stopped and it is lifted away from the paper. The correction tape dispensers currently available work generally satisfactorily, but they are not without their drawbacks. Some require the holders to be held in rather unnatural or awkward orientations. In addition, some care or skill is needed to ensure that the edge remains flat on the surface when laying down a strip of coating composition otherwise it may not release correctly from the ribbon with the result that the strip laid down onto the paper will be ragged or incomplete. To overcome this problem it has been proposed in our copending International patent application No. PCT/US94/06585 to mount the application element for pivotal movement about an axis ideally disposed substantially in the plane of the paper and perpendicular to the edge. Another drawback suffered by known correction tape dispensers is that the edge must be initially oriented and maintained substantially perpendicular to the direction of movement of the applicator tip across the paper surface when laying down a strip of coating composition otherwise there is a strong tendency for the tape to slide along the edge, possibly becoming disengaged from it completely, which again will detract from smooth operation of the dispenser.

The present invention addresses the latter drawback and as a solution it proposes a tape dispenser for applying a strip of a coating composition to a substrate, comprising a holder containing a supply spool of tape consisting of a carrier ribbon coated on one side with the coating composition, and a take-up spool for used tape consisting of carrier ribbon from which the coating composition has been removed, the tape being guided to pass between the supply and take up spools around an edge of an application tip element used to press the carrier ribbon against the substrate to transfer the coating composition onto the substrate, wherein the application tip element is coupled to the holder for movement about a predetermined axis substantially aligned with the direction in which the application tip element is pressed against the substrate in use of the dispenser, whereby frictional forces exerted on the application tip element during movement of the application tip element across the substrate surface cause the application tip element to move about said predetermined axis to maintain the edge substantially perpendicular to the direction of said movement of the application tip element across the substrate surface.

By providing the application tip element with some freedom of movement about a generally upright predetermined axis, the element is able to adjust and compensate for failure of the user to present the edge against the substrate to lie perpendicular to the length of the strip of composition to be laid down, and/or to maintain this orientation of the edge throughout the length of displacement of the edge across the surface. In order to encourage the automatic adjustment of the application element under the effect of the frictional forces it experiences during the operation of laying down a strip of coating composition, the axis is preferably defined at a position spaced at a small distance in front of the edge of the application tip element. The predetermined axis can be defined by a bearing means, such as a shell bearing, but in an especially convenient construction the axis is defined by an integral hinge. The hinge is preferably adapted to bias the application tip element to a central rest position from which the element is angularly displaceable about the axis in both directions. However, separate or alternative spring means could be provided for this purpose, and the tension of the tape itself can have a centering effect on the application tip element.

A tape dispenser constructed in accordance with the present invention can also embody the invention of the aforementioned copending application No. PCT/US94/06585. Thus, in a currently preferred embodiment, the application tip element of the tape dispenser is also pivotable relative to the holder about a pivot axis substantially perpendicular to the edge of the application tip element and substantially perpendicular to the first mentioned predetermined axis.

A better understanding of the invention and its preferred features will be gained from the more detailed description which follows reference being made to the accompanying drawings, in which:

DETAILED DESCRIPTION OF THE DRAWINGS

Figure 1:
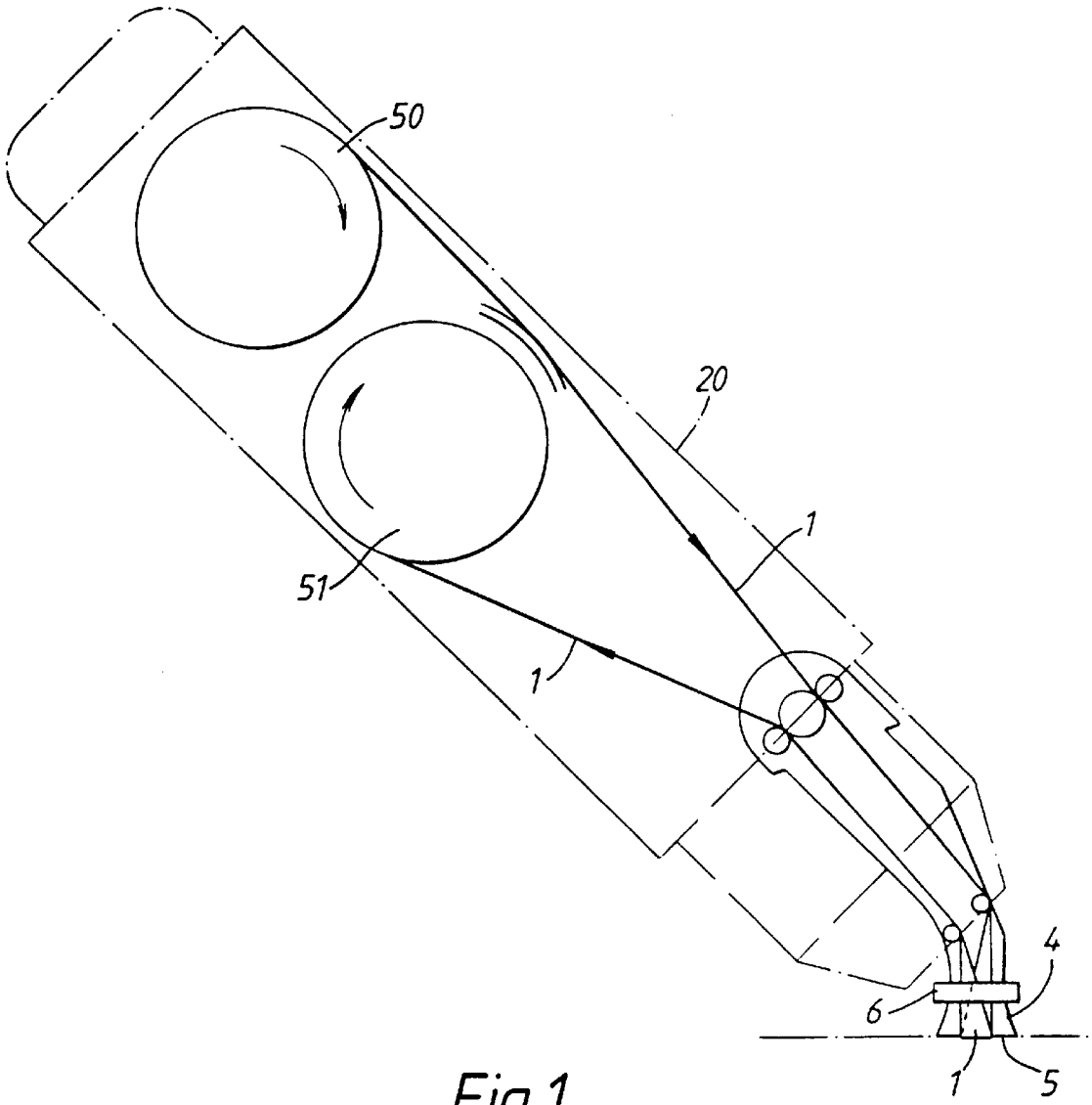
FIG. 1 shows schematically a correction tape dispenser according to the invention.
Figure 2A:
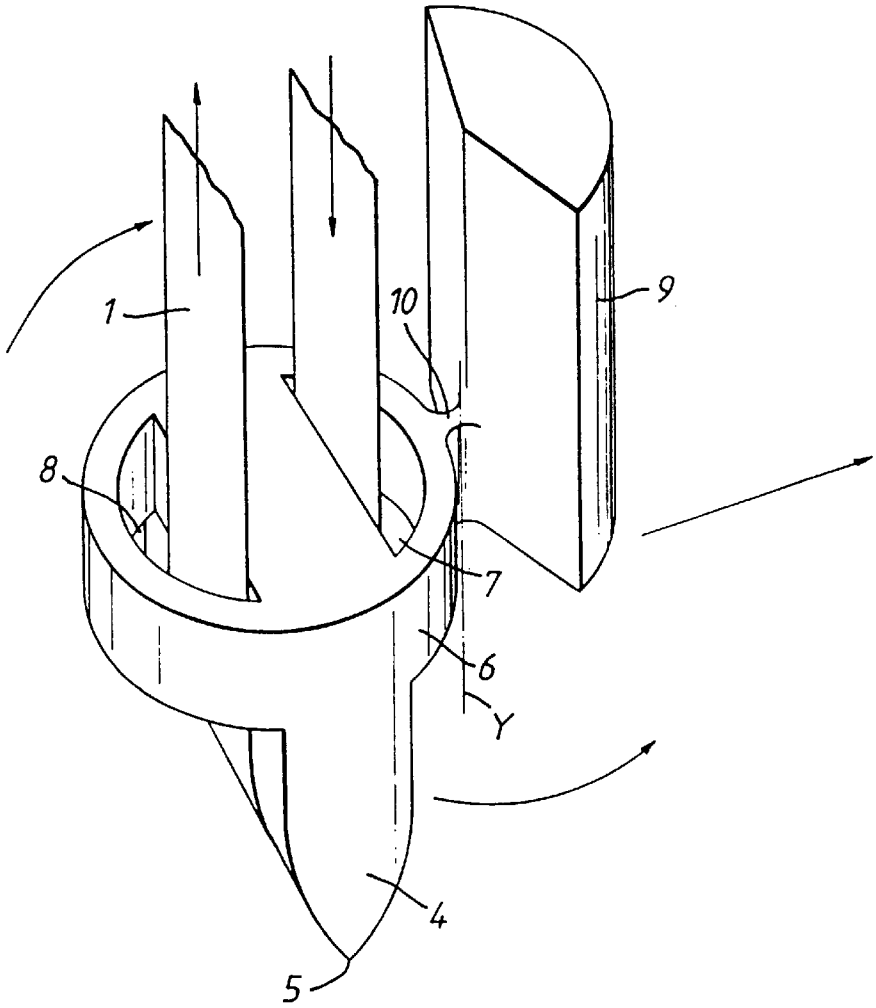
FIG. 2A is a perspective view illustrating a first embodiment of the present invention.
Figure 2B:
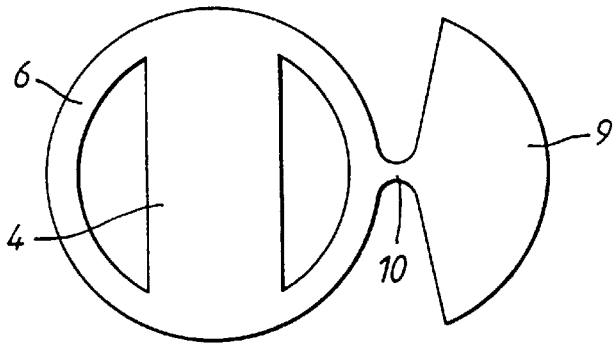
FIG. 2B is a plan view of the correction tape dispenser applicator tip assembly shown in FIG. 2.

The dispenser generally illustrated in FIG. 1 comprises a body or holder 20 housing tape supply and take-up spools 50, 51 which are most conveniently rotatable about parallel axes as shown, or a common axis, and are coupled by a slipping drive mechanism so that when the tape 1 is drawn from the supply spool 50 the take-up spool 51 is rotated to reel in an equal amount of tape. The tape 1 is conventional having a layer of correction composition coating one side of a carrier ribbon. Shown in FIGS. 2A and 2B is the tape applicator tip assembly of the correction tape dispenser. A length of tape extending between the supply and take-up spools is guided to pass around an application tip element 4 defining an edge 5 which is used to press the tape against a paper surface and which forms a sharp bend in the tape path to facilitate release of the correction composition from the carrier ribbon and hence its transfer to the paper surface. The element consists of a blade member integral with a support ring 6 through which tape guidance slots 7 and 8 are provided either side of the blade member. At a position at 90° to the plane of the edge 5, the support ring is connected to a mounting part in the form of a post 9 by an integral hinge 10 which defines a predetermined axis Y, referred to herein below as the yaw axis, substantially aligned with the direction in which the application tip element is pressed against the substrate in use of the dispenser. The tape 1 is guided to pass from the supply spool, down through the slot 7, around the edge 5, up through the slot 8 and then onto the take-up spool. In use, the edge 5 is pressed down onto the paper surface by means of the holder of the dispenser to which the mounting post 9 is substantially rigidly attached, and the edge is moved across the surface in the direction substantially perpendicular to the edge 5 and towards the post 9. The pressure applied against the tape causes the correction composition to adhere to the paper and the tip edge slides over the tape ribbon causing fresh tape to be drawn from the supply spool and laid down in front of the tip edge 5 while ribbon on the trailing side of the edge is reeled up by the take-up spool, the correction composition coating having been left on the paper surface. If the tip edge 5 is not oriented strictly perpendicular to the direction in which it is displaced across the paper surface, at any time during the stroke of the tip to lay down a continuous strip of correction composition, the applicator element will pivot about the yaw axis Y which is substantially perpendicular to the paper surface and is defined by the hinge 10, to establish or re-establish the correct orientation of the edge 5 perpendicular to the direction of motion. Consequently, the user is not required to maintain strict orientation of the holder throughout the displacement of the dispenser to supply a continuous strip of correction composition.

Figure 3:
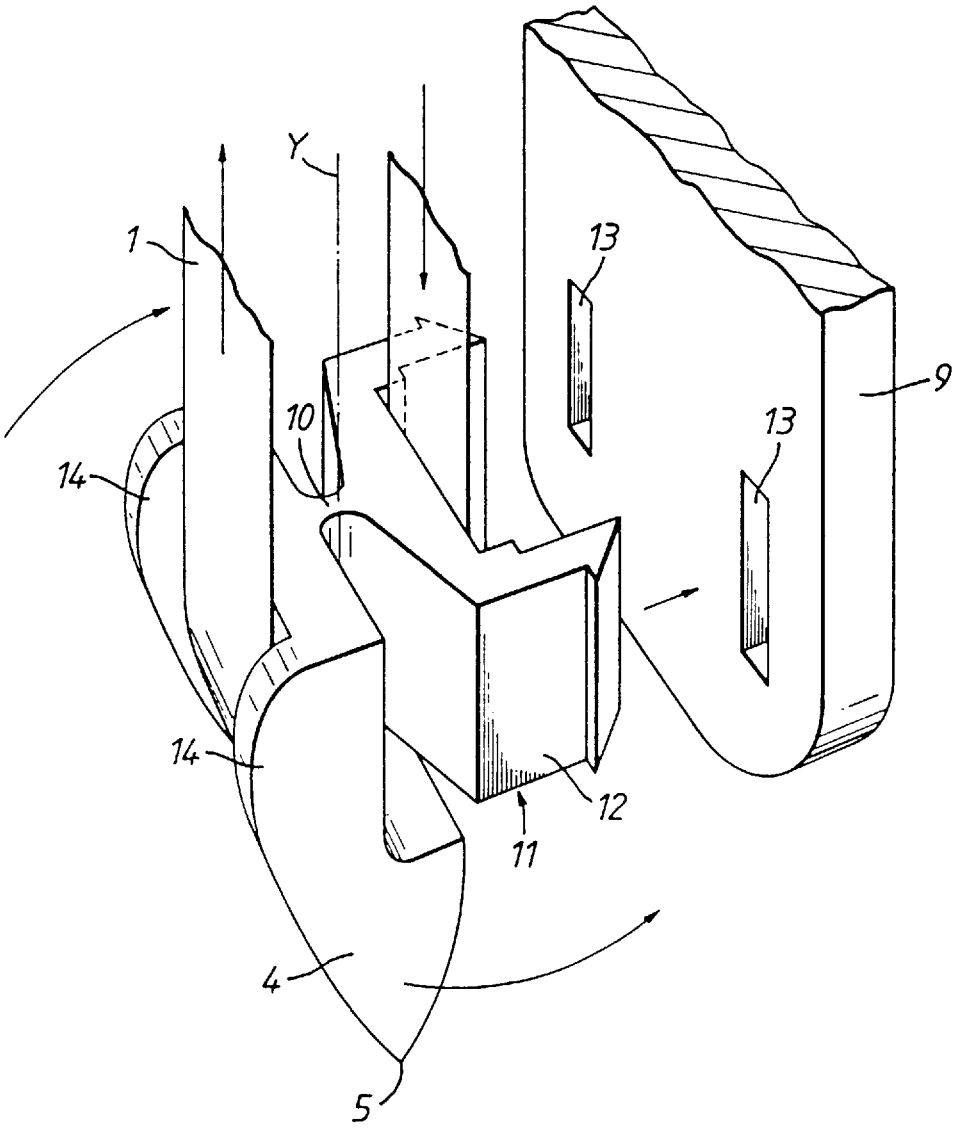
FIG. 3 is an exploded perspective view showing a modified applicator tip assembly similar to the embodiment of FIG. 2.

The tip element of FIG. 3 is fundamentally similar to that of FIGS. 2A and 2B, but the integral hinge is defined by the element itself rather than at its connection to the mounting part which in this embodiment has the form of a plate 9. The blade member 4 defining the edge 5 is connected by the hinge 10 to a yoke member 11 defining a pair of arms 12 which engage with a snap fit into slots 13 provided in the plate 9. On the leading side of the edge 5 a guidance slot for the tape 1 is defined between the yoke member 11 and the plate 9 and on the trailing side of the edge the blade member is provided with spaced wing-like protrusions 14 defining a channel to guide the tape. As in the first embodiment, the hinge 10 allows pivotal adjustment of the edge 5 about a predetermined axis to compensate for incorrect orientation of the dispenser holder with respect to its direction of displacement in laying down a strip of correction composition. Because the hinge axis is closer to the edge 5 than in the first embodiment, the castoring effect tending to dispose the edge perpendicular to the direction of movement will be reduced and the resilience of the hinge may be somewhat less.

In the embodiments of FIGS. 1, 2 and 3, the hinge 10 is preferably defined to exert a restoring force so that the edge of the application tip element is biased to a central normal rest position about the yaw axis. Alternatively, separate springs could be applied for this purpose. In addition, the hinge could be formed to permit a degree of rocking movement about a pitch axis generally perpendicular to the yaw axis and to the edge 5.

Figure 4:
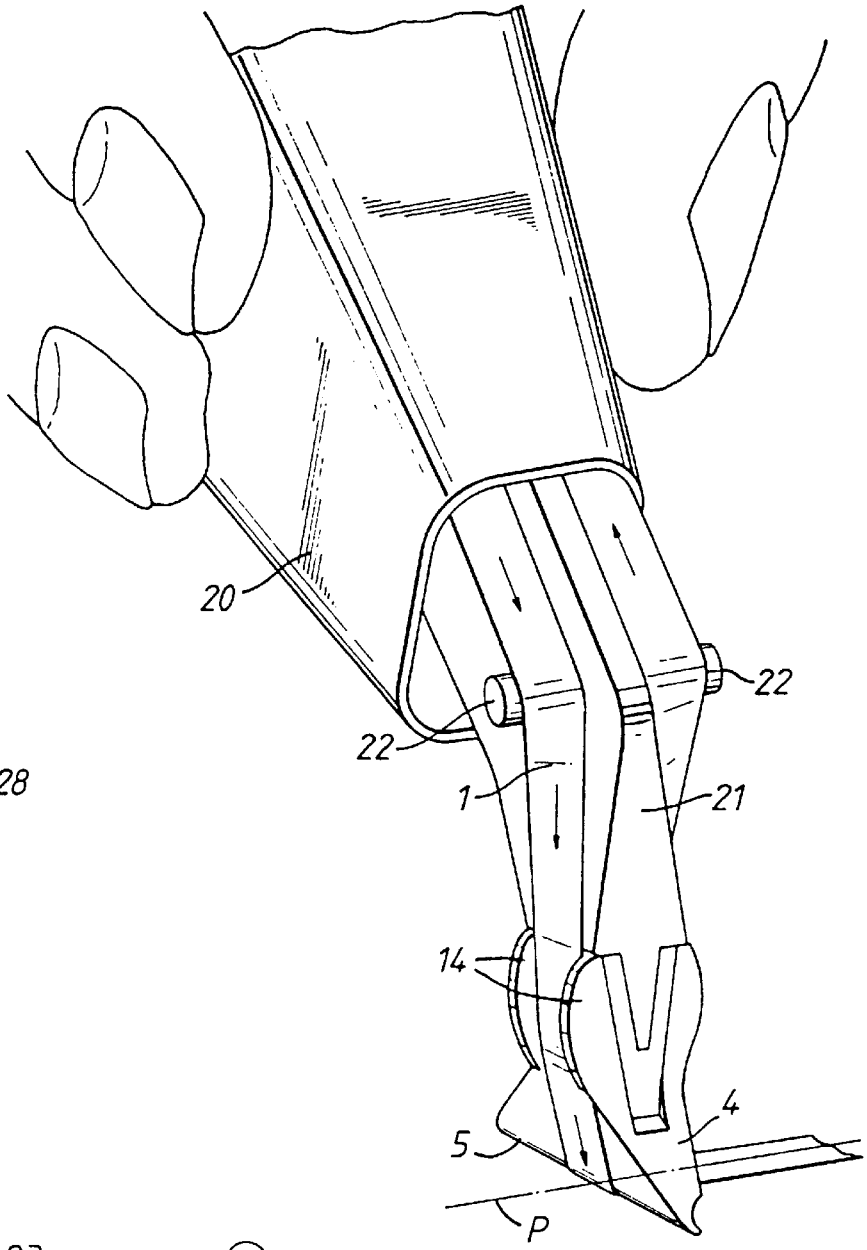
FIG. 4 is a perspective view showing another embodiment of the invention which also includes a bearing as described in the aforementioned International application No. PCT/US94/06585 to enable the applicator tip to rock to adjust itself to lie flat against a surface without demanding that the body of the dispenser is held in a strictly predetermined orientation relative to the paper.
Figure 5:
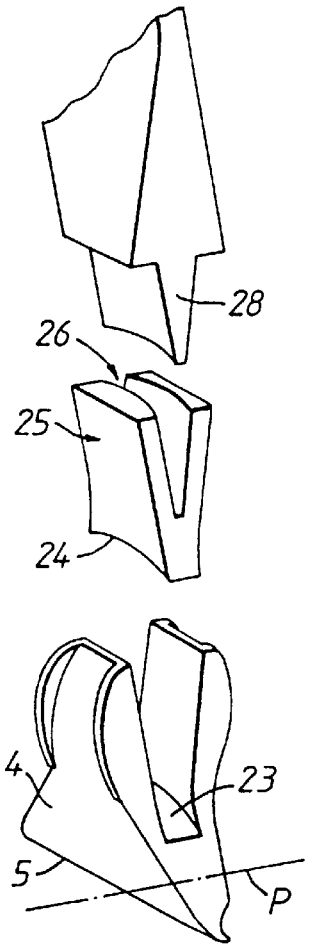
FIG. 5 is an exploded perspective illustration of the applicator tip assembly incorporated in the FIG. 4 embodiment.
Figure 6A:
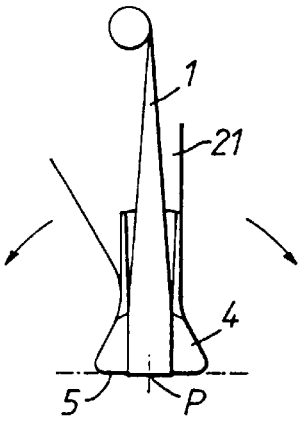
FIGS. 6A and 6B are sketches showing the two freedoms of movement permitted by the tip assembly of FIGS. 4 and 5.
Figure 6B:
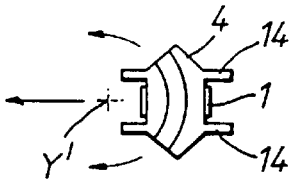

FIGS. 4 to 6 illustrate an embodiment of the invention including a bearing to allow pivotal movement of the application tip element about a pitch axis, and in this respect the correction tape dispenser is substantially as described in the above mentioned International application No. PCT/US94/06585. The supply and take-up spools are housed in the body or holder 20 from the forward end of which protrudes a tip element mounting in part 21 having tape guiding posts 22. The application edge 5 is formed on a tip element 4 having wings 14 for tape guidance on either side. A notch or slot in this element has a bearing surface 23 which cooperates with a complementary bearing surface 24 of a bearing member 25 to form a shell bearing defining a pitch axis P about which the element is able to rock freely. The pitch axis intersects the edge 5 and extends essentially in the direction in which the edge is moved over the paper surface. The bearing member 25 is also provided with a slot 26 into which is received a tongue 28 provided at the end of the mounting part 21. The tongue and slot have complementary arcuate side surfaces and cooperate to form a shell bearing defining a virtual yaw axis Y' which is substantially perpendicular to the pitch axis P and to the edge 5, and which in use is substantially perpendicular to the paper surface and disposed a short distance in front of the edge 5. As illustrated in FIGS. 6A and 6B, the double shell bearing arrangement enables the application tip element 4 to adjust automatically to ensure the edge is applied flat against the paper by rocking about the pitch axis P and to ensure the edge is perpendicular to the direction of displacement by pivoting about the yaw axis Y'.

Figure 7:
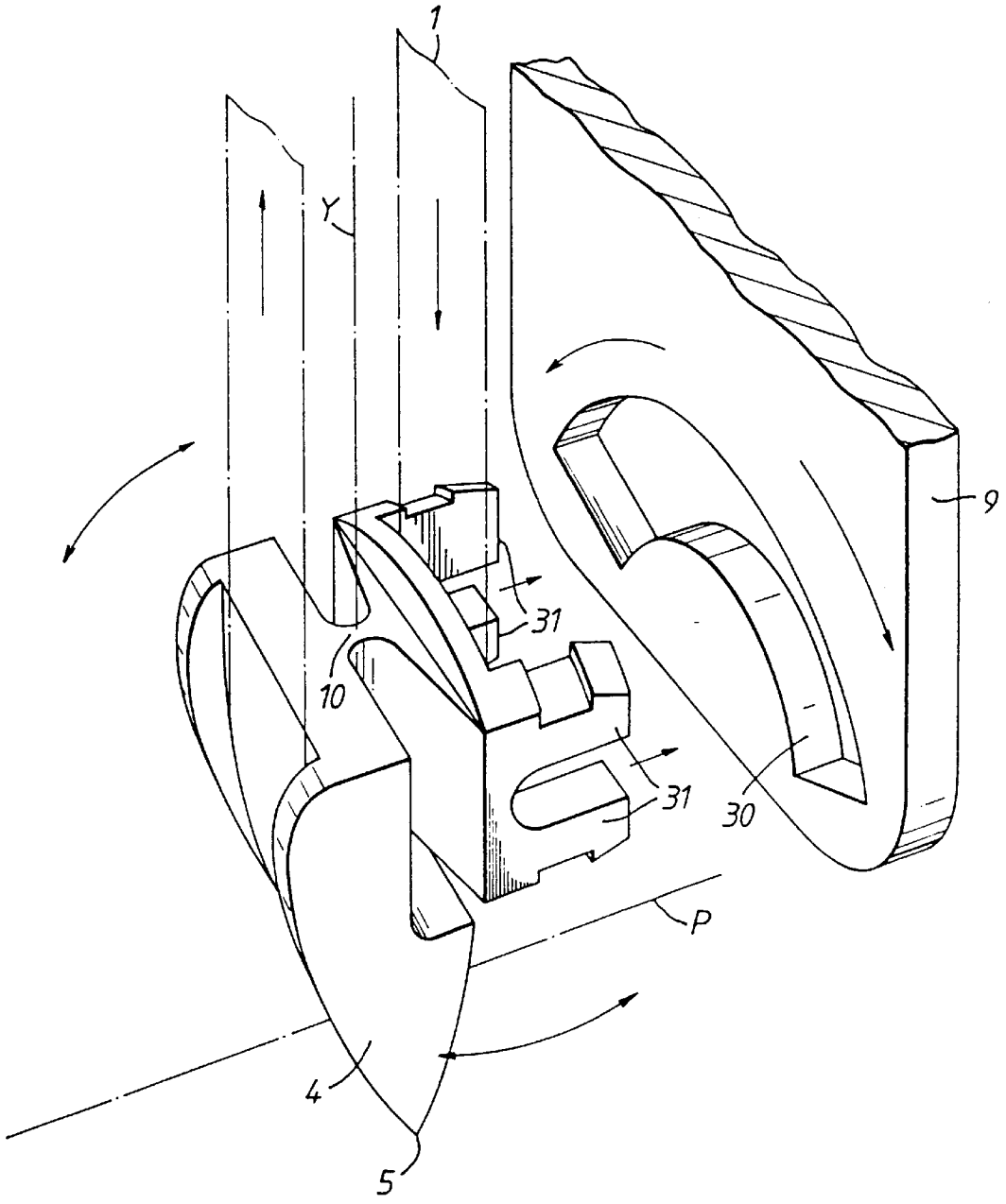
FIG. 7 shows in perspective an applicator tip similar to FIG. 3 but adapted to enable rocking motion of the applicator tip element as in the embodiment of FIGS. 4–6.

FIG. 7 illustrates a presently preferred embodiment of the invention. The tip element is basically as described above in relation to FIG. 3, with the integral hinge 10 defining the yaw axis Y. Instead of two arms engaging firmly in respective slots, the mounting plate 9 is provided with an arcuate slot 30 and the yoke arms are bifurcated to form pairs of pegs 31 which are snap fitted into the slot 30. The pegs cooperate with the curved surfaces of the slot to form a shell bearing defining a pitch axis P perpendicular to the edge 5 and to the yaw axis Y. Due to the freedom of pivotal movement permitted about the pitch and yaw axes, the tip element 4 can adjust automatically so that it is applied and maintained in correct orientation relative to the paper surface.

In the embodiments of FIGS. 1–3 and 7 it is not essential for the hinges to be integrally formed and they could comprise separate parts if this is considered more convenient or desirable, e.g. to allow different material for the support member tip element.

In each of the described embodiments, the supply and take-up spools can be disposed in the dispenser body with guide means for guiding the tape to the applicator edge as described in our pending patent application No. GB 2275042, so that the dispenser can be held in use in similar orientation to that in which a writing instrument is generally held.

We claim:

1. A tape dispenser for applying a strip of a coating composition to a substrate, comprising a holder containing a supply spool of tape consisting of a carrier ribbon coated on one side with the coating composition, and a take-up spool for used tape consisting of carrier ribbon from which the coating composition has been removed, the tape being guided to pass between the supply and take-up spools around an edge of an application tip element used to press the carrier ribbon against the substrate to transfer the coating composition onto the substrate, wherein the application tip element is coupled to the holder for movement about a predetermined axis substantially aligned with the direction in which the application tip element is pressed against the substrate in use of the dispenser, whereby frictional forces exerted on the application tip element during movement of the application tip element across the substrate surface cause the application tip element to move about said predetermined axis to maintain the edge substantially perpendicular to the direction of said movement of the application tip element across the substrate surface.

2. A tape dispenser according to claim 1, wherein the predetermined axis is spaced in front of the edge in the direction of movement across the substrate for applying the coating composition thereto.

3. A tape dispenser according to claim 1, wherein the application tip element is coupled to a mounting part connected to the holder through bearing means defining said axis.

4. A tape dispenser according to claim 1, wherein the application tip element includes an integral hinge defining said predetermined axis.

5. A tape dispenser according to claim 1, wherein the application tip element is moveable about said predetermined axis to either side of a normal position into which said application tip element is biased.

6. A tape dispenser according to claim 1, wherein the application tip element is also pivotable relative to the holder about a pivot axis substantially perpendicular to said edge and to said predetermined axis.

7. A tape dispenser according to claim 6, wherein said pivot axis substantially intersects said edge.

8. A tape dispenser according to claim 6, wherein said pivot axis is defined by a shell bearing connecting the applicator tip to a mounting part attached to the holder.

9. A tape dispenser according to claim 6, wherein the mounting part comprises an arcuate bearing slot and projections on the application tip element engage in said slot to attach the application tip element to the support member.

10. A tape dispenser according to claim 9, wherein the projections are provided by a yoke member connected to the application tip element by an integral hinge defining said predetermined axis.

* * * * *